US007628504B2

(12) United States Patent
Glickman

(10) Patent No.: US 7,628,504 B2
(45) Date of Patent: Dec. 8, 2009

(54) LIGHT FIXTURE RETROFITTING APPARATUS AND METHOD

(76) Inventor: Mark F. Glickman, 110 Seminole Way, Rochester, NY (US) 14618

( * ) Notice: Subject to any disclaimer, the term of this patent is extended or adjusted under 35 U.S.C. 154(b) by 154 days.

(21) Appl. No.: 11/484,808

(22) Filed: Jul. 11, 2006

(65) Prior Publication Data

US 2007/0008716 A1 Jan. 11, 2007

Related U.S. Application Data

(60) Provisional application No. 60/698,198, filed on Jul. 11, 2005.

(51) Int. Cl.
*F21S 8/06* (2006.01)

(52) U.S. Cl. ..... 362/148; 362/147; 362/150; 362/406; 362/457

(58) Field of Classification Search ..... 362/148, 362/150, 145
See application file for complete search history.

(56) References Cited

U.S. PATENT DOCUMENTS

| | | | | |
|---|---|---|---|---|
| 4,807,099 | A | 2/1989 | Zelin | |
| 4,956,758 | A | 9/1990 | Aubrey et al. | |
| 5,031,084 | A * | 7/1991 | Russo et al. | 362/365 |
| 5,083,248 | A | 1/1992 | Troy | |
| 5,463,540 | A | 10/1995 | Jones | |
| 5,465,199 | A * | 11/1995 | Bray et al. | 362/364 |
| 6,168,285 | B1 | 1/2001 | Flohre | |
| 6,241,368 | B1 * | 6/2001 | Depino | 362/364 |
| 6,752,513 | B2 | 6/2004 | Plunk | |
| 6,957,896 | B2 * | 10/2005 | Burgess | 362/147 |
| 6,979,108 | B1 * | 12/2005 | Berge | 362/442 |
| 7,118,254 | B2 * | 10/2006 | Czech | 362/365 |
| 7,347,580 | B2 * | 3/2008 | Blackman et al. | 362/147 |
| 7,438,433 | B1 * | 10/2008 | Steadman et al. | 362/147 |
| 2006/0152920 | A1 * | 7/2006 | Blackman et al. | 362/147 |

FOREIGN PATENT DOCUMENTS

| | | |
|---|---|---|
| EP | 0 370 825 B1 | 8/1995 |
| EP | 1 045 194 A2 | 10/2000 |

OTHER PUBLICATIONS

Recessed to Track Converter, Model A25, Hampton Bay, Printed Box Sides, Homer TLC, Inc. 2004.

* cited by examiner

*Primary Examiner*—Anabel M Ton
(74) *Attorney, Agent, or Firm*—Kenneth J. Lukacher; Martin Lukacher

(57) ABSTRACT

The invention comprises, in one form thereof, a light fixture for retrofitting a non-recessed ceiling lamp, such as a pendant lamp, to an existing recessed light fixture. The light fixture includes a mounting bracket and a power adapter. The mounting bracket cooperates with screws that affix the existing, recessed light fixture to the existing mounting structure. The non-recessed lamp is mounted to the mounting bracket as it would normally be mounted to the ceiling. The recessed lighting baffle may be removed. The power adapter is screwed into the recessed light fixture's existing light bulb receptacle and includes an electrical outlet that receives a power plug that is wired to the non-recessed lamp's power cord. Alternatively, the power cord is wired directly to the power adapter.

21 Claims, 11 Drawing Sheets

LIGHT FIXTURE RETROFITTING APPARATUS AND METHOD

This application claims the benefit of priority to U.S. Provisional Patent Application No. 60/698,198, filed Jul. 11, 2005.

FIELD OF THE INVENTION

This invention relates to light fixtures, and relates particularly to an apparatus and method for retrofitting an existing recessed light fixture for installation of a non-recessed light fixture, such as for a pendant lamp or other non-recessed lamp extending from a ceiling.

BACKGROUND OF THE INVENTION

When remodeling a room, a person may choose to replace recessed light fixtures with one or more non-recessed light fixtures. Upon consultation with a contractor, the person is often told that such a replacement requires the removal of the plaster or dry wall from the ceiling and the removal of the recessed lighting fixtures before the non-recessed lamps are mounted to the ceiling, connected to the building's power lines, and the ceiling is replaced. This method is exorbitant and expensive and may inconveniently tie up a room, such as a kitchen or a living room, for an extended period of time. What is therefore needed is an apparatus and method for installing non-recessed lamps where recessed light fixtures have been previously installed that is less expensive, less exorbitant, and easier to perform than what is conventionally used.

There exists a number of U.S. patents directed to light fixtures including U.S. Pat. No. 4,956,758 issued to Aubrey, et al. Aubrey teaches a light fixture in which one end of an elongated beaded chain is secured in a screw base with a spring loaded connection. The chain extends downward through a central opening in a cover and in a reflector, which includes a locking slot into which the chain can be placed. After the screw base is threaded into a conventional socket, the chain is passed through the opening as the reflector is drawn up into the opening for the existing recessed fixture. The fixture includes a trim ring which is placed against the ceiling which surrounds the recessed fixture. The chain is then pulled down against the spring in the screw base, pulled to the side into engagement with the slot portion of the opening, and released. The spring pulls upwardly on the chain and seats the new fixture against the ceiling. Aubrey doesn't show a pendant lamp nor a support bracket, which would be required to support such a lamp. Therefore, a light fixture that may be affixed to an existing recessed light fixture and includes a bracket for supporting a pendant lamp is needed.

U.S. Pat. No. 5,463,540 issued to Jones teaches a kit for replacing existing incandescent fixtures with a fluorescent fixture. The kit includes a plate with a ballast/transformer on the upper surface and a 2D lamp socket on the lower surface. The ballast/transformer is coupled to the source of power through a separable connector which can be terminated either in an electrical plug which fits into an existing socket or, using conventional wire connectors, can be "hard wired" into place. Spring hangers, which can be attached to existing housing features, are loosely held to the upper surface of the plate so that in a first orientation, the plate is below the housing and access may be had to the housing interior and in a second orientation, the plate is held secure against the housing. In an alternative embodiment, the lamp is connected to the power source by a candelabra base or screw base. Jones relies on a spring force to bias the lamp in position and Jones's bracket is below the can, not within it. Further, Jones teaches a fluorescent ceiling lamp that is not a pendant lamp. Therefore, a light fixture that may be affixed to an existing recessed light fixture and that can support a pendant lamp is needed.

European Patent Number 0 370 825 B1 issued to Hudson on Aug. 16, 1995 teaches an electrical coupling device for detachably securing a fixture to an electrical outlet (or junction) box that includes two complimentary support plates. The fixture is connected to one plate and the other plate is affixed to the electrical outlet box. The electricity is passed between at least two spaced-apart female resilient clips of electrically conductive metal on one plate and at least two spaced-apart contacts of electrically conductive metal on the other plate. The electrical coupling device is characterized by minimal protrusion in the electrical junction box; direct mounting by means of a one-step rotation; and applicability to a wide range of fixtures and sizes of electrical outlet boxes; and direct mounting without the requirement of an outlet box. Hudson does not describe retrofitting the lamp to a recessed light fixture, or the use of a screw base or similar power adapter to provide power for the lamp. Therefore, a light fixture that may be affixed to an existing recessed light fixture and includes a simple to use device for connecting the lamp to a power supply is needed.

SUMMARY OF THE INVENTION

Accordingly, the present invention provided an improved apparatus and method for retrofitting an existing recessed lamp housing for installation of a pendant light or other non-recessed lamp extending from a ceiling.

The invention comprises, in one form thereof, a light fixture for retrofitting a ceiling lamp, such as a pendant lamp, to an existing recessed light fixture. The light fixture includes a mounting bracket and a power adapter. The mounting bracket cooperates with screws that affix the existing, recessed light fixture (also known as a can) to the existing mounting structure. The non-recessed light is mounted to the mounting bracket as it would normally be mounted to the ceiling. The recessed lighting baffle may be removed. The power adapter is screwed into the can's existing light bulb receptacle and includes an electrical outlet that receives a power plug that is wired to the non-recessed lamp's power cord. Alternatively, the power cord is wired directly to a one-piece power adapter.

More particularly, the invention includes a light fixture including a mounting bracket that is fixable to an interior surface of a recessed light fixture, a power adapter that mates with a light bulb receptacle, wherein the light bulb receptacle is affixed to the recessed light fixture, and a non-recessed lamp that is in electrical communication with the power adapter and that is fixable to the mounting bracket.

Preferably, the mounting bracket has a plate and multiple prongs, such as three, extending radially outward from a plate in which the ends of the prongs each have a slot for receiving one of the existing fasteners, such as screws, which mount the recessed can to the recessed lamp assembly mounted in the ceiling. The prongs may be L-shaped, C-shaped, or D-shaped, and may have fastener locking slots. The prongs are preferably D-shaped, such that they having a bend along which the prongs are bendable radially outward or inward to size the prongs to the interior surface of a recessed light can, such that prongs can be readily mounted to the existing fasteners of the recessed light can.

In another form, the invention includes a method for retrofitting a non-recessed light fixture to an existing recessed light fixture. The method comprises the steps of affixing a mounting plate to the existing fixture, which is mounted to a support structure using a plurality of fasteners. The mounting plate is affixed to the existing fixture by the same plurality of fasteners. A non-recessed lamp is wired to a power adapter that mates with a light bulb receptacle associated with the existing fixture. The power adapter is mated to the light bulb receptacle and the non-recessed lamp is mounted to the mounting plate.

An advantage of the invention is that the apparatus and method are simple and inexpensive, especially when compared to conventional methods that require the removal of portions of the ceiling and removal of the existing lamps. The invention takes advantage of the existing mounting structure and power connections of the recessed light fixture and includes a bracket that is able to support heavier lamps such as non-recessed lamps. The invention has the further advantages that the mounting bracket is hidden within the recessed light fixture and that the device for connecting the lamp to the power supply is simple to use.

BRIEF DESCRIPTION OF THE DRAWINGS

The above-mentioned and other features and advantages of this invention, and the manner of attaining them, will become apparent and be better understood by reference to the following description of several embodiments of the invention in conjunction with the accompanying drawings, wherein.

Corresponding reference characters indicate corresponding parts throughout the several views. The example set out herein illustrates one embodiment of the invention but should not be construed as limiting the scope of the invention in any manner.

DETAILED DESCRIPTION

Figure 1A:
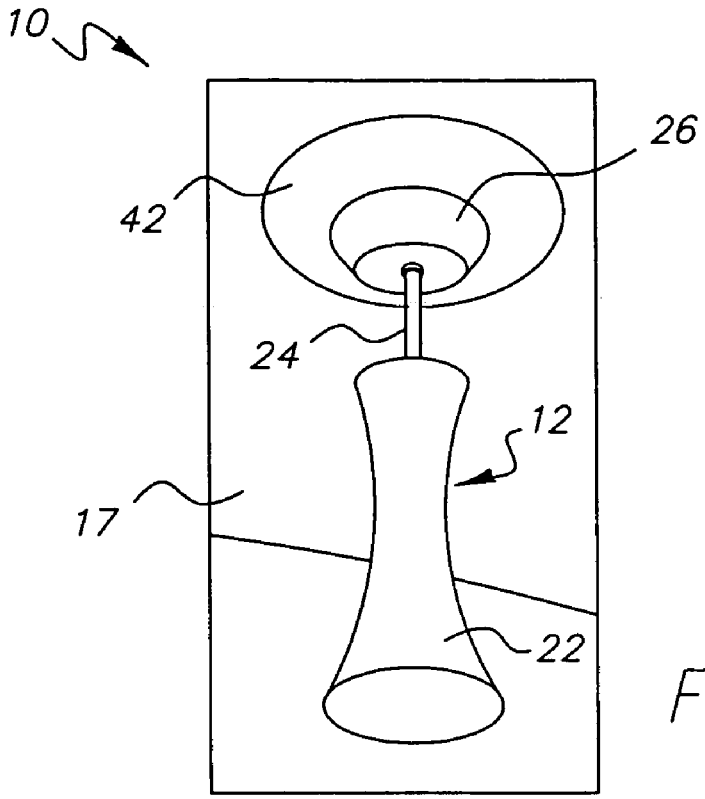
FIG. 1*a* is an image of the retrofitting light fixture and pendant lamp of the present invention.
Figure 1B:
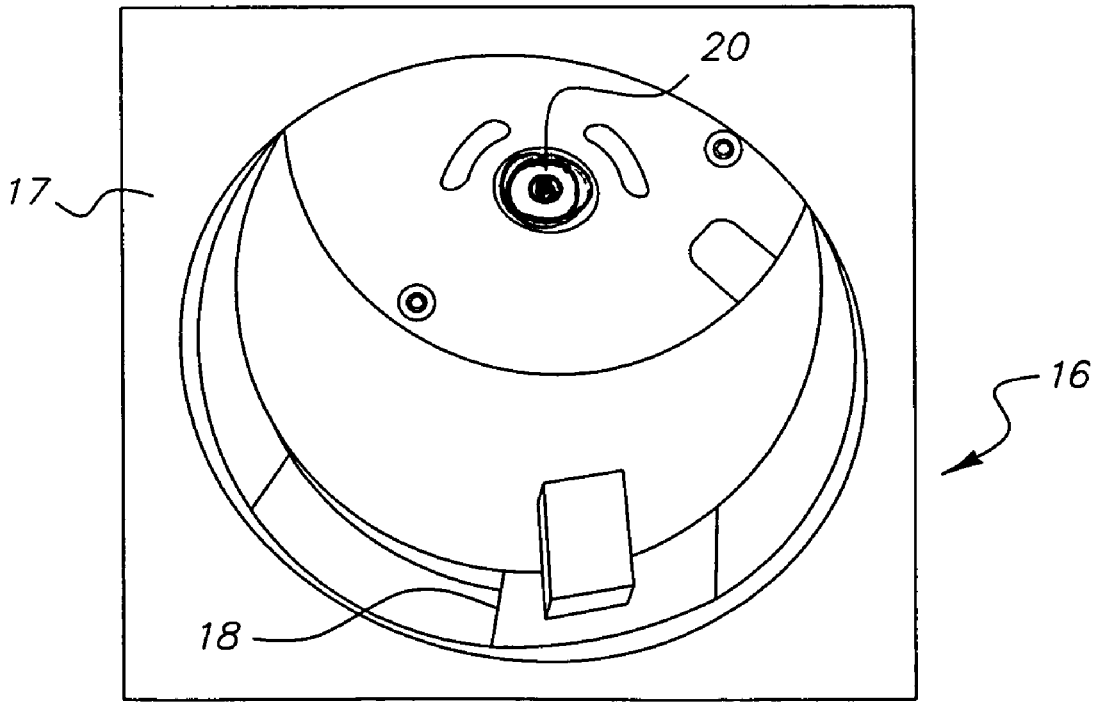
FIG. 1*b* is an image of an existing recessed light fixture.

Referring to FIGS. 1*a* and 1*b*, there is shown the light fixture retrofitting apparatus of the present invention. The apparatus 10 includes a pendant lamp 12, retrofitting components 14 (FIG. 2), and an existing recessed light fixture 16. The recessed light fixture 16 is mounted within a ceiling 17 and includes a recessed housing or can 18 and a light bulb receptacle 20. As best shown in FIG. 1*b*, the can 18 has a closed end having light bulb receptacle 20, and an open end extending to ceiling 17.

Figure 2:
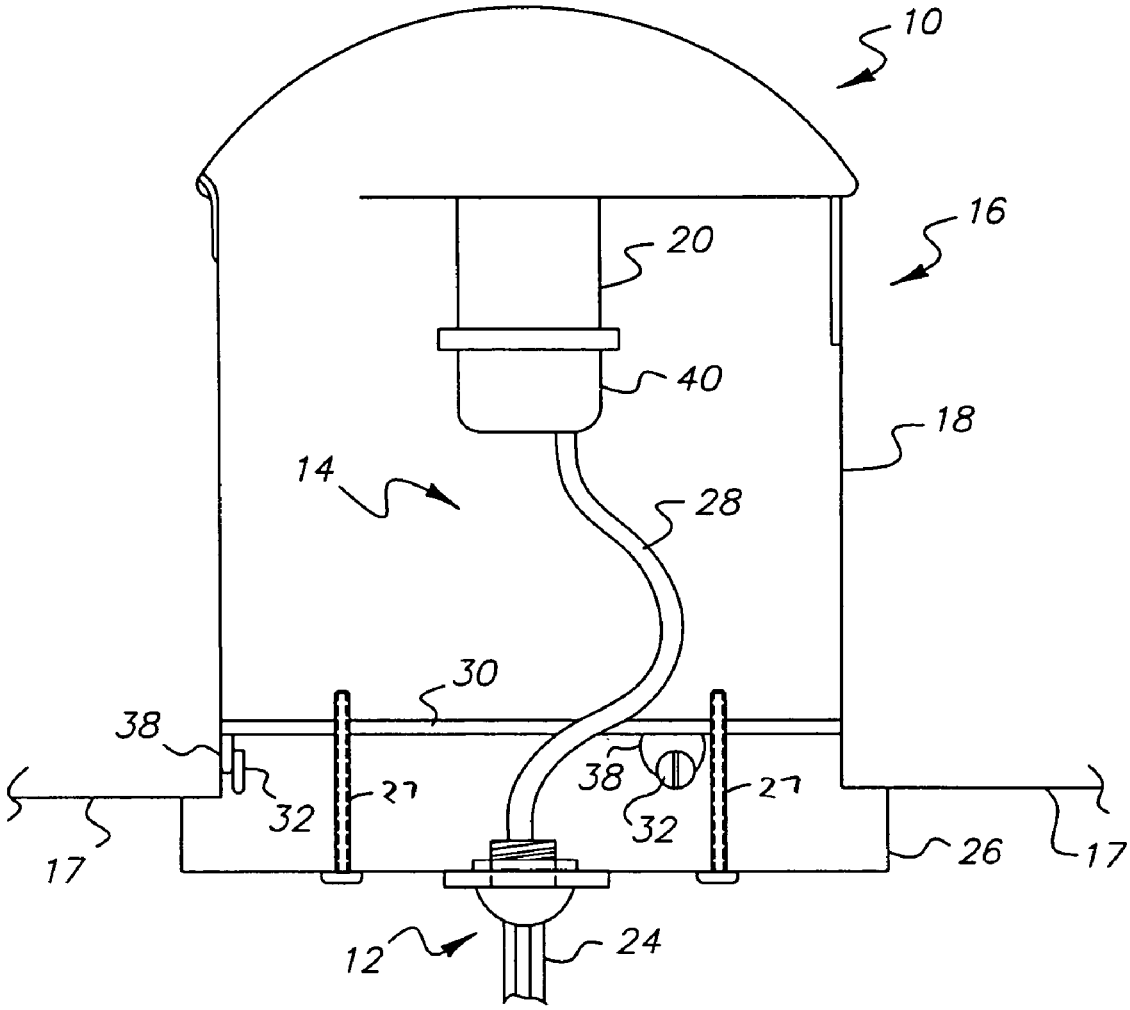
FIG. 2 is a cross-sectional view of the retrofitting light fixture of FIG. 1.

The pendant lamp 12 includes a shade 22, a stem 24, a canopy 26, and a power cord 28, shown in FIG. 2. The stem 24 may be configured to receive an incandescent, fluorescent, or other type of light bulb. The features of alternative pendant lamps may vary from the one shown and additional features may be included.

Figure 3A:
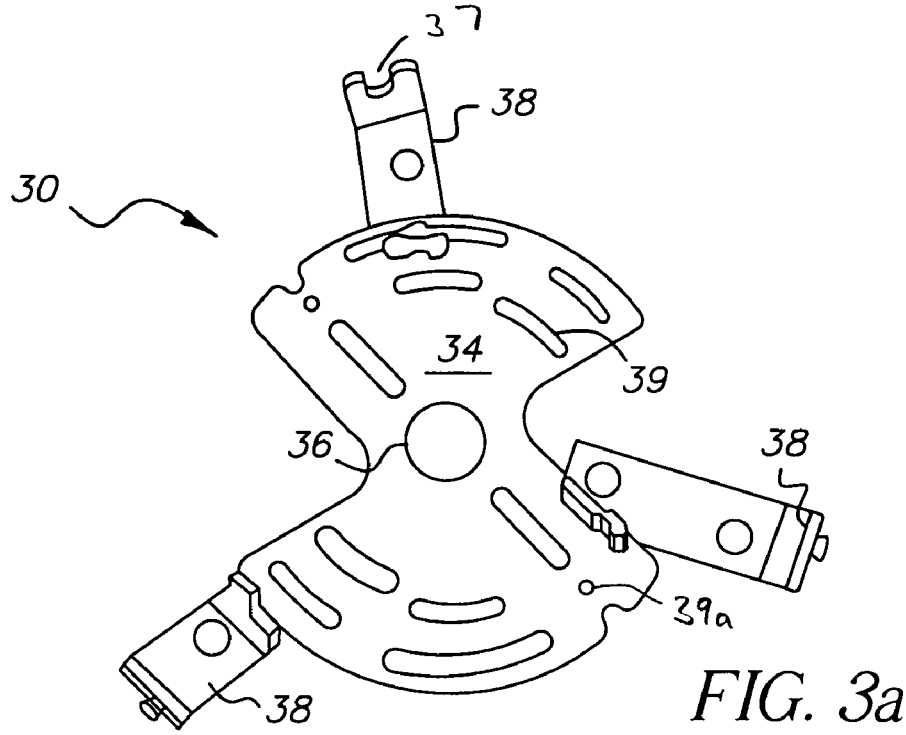
FIG. 3*a* is an image of a mock-up of the bracket of FIG. 2.
Figure 3D:
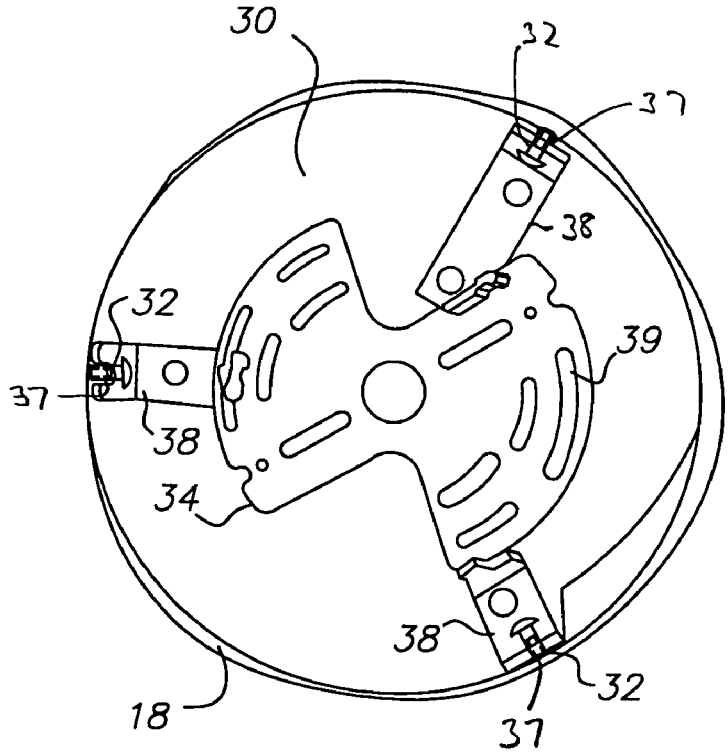
FIG. 3*d* is an image of the bracket of FIG. 2 mounted to a recessed light fixture.
Figure 3B:
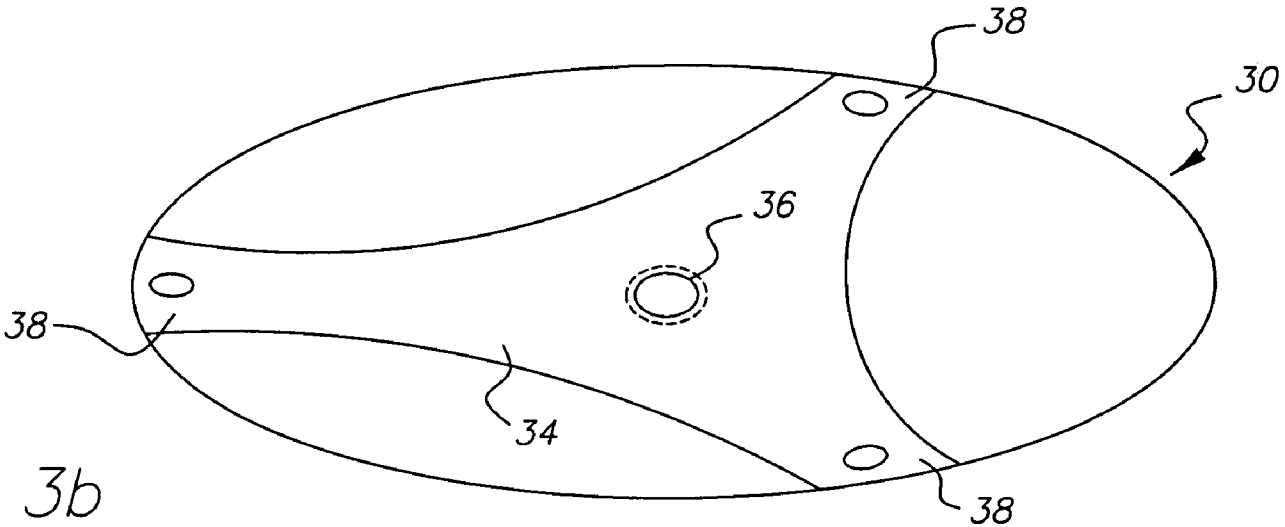
FIG. 3*b* is an isometric view of the bracket of FIG. 2.
Figure 3C:
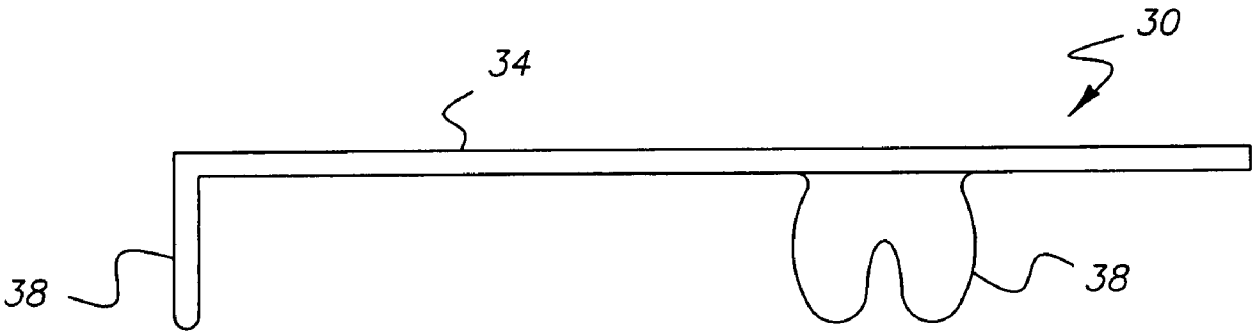
FIG. 3*c* is a side view of the bracket of FIG. 2.

The retrofitting components 14, shown in FIG. 2, include a mounting bracket 30 that is affixed to the can 18 by fasteners 32, which also secure the can 18 to a mounting structure in the ceiling 17. The mounting bracket 30 is shown in greater detail in FIGS. 3*a*-3*c*. The mounting bracket 30 includes a lamp mounting portion (or plate) 34 with a bore (or opening) 36 for the power cord 28 and L-shaped prongs 38, which engage the fasteners 32 via slots 37 at the end of the prongs, as shown in FIG. 3*d*. The mounting bracket 30 further includes a plurality of slots 39 and holes 39*a* for accommodating various mounting configurations of different non-recessed lamps.

Figure 3E:
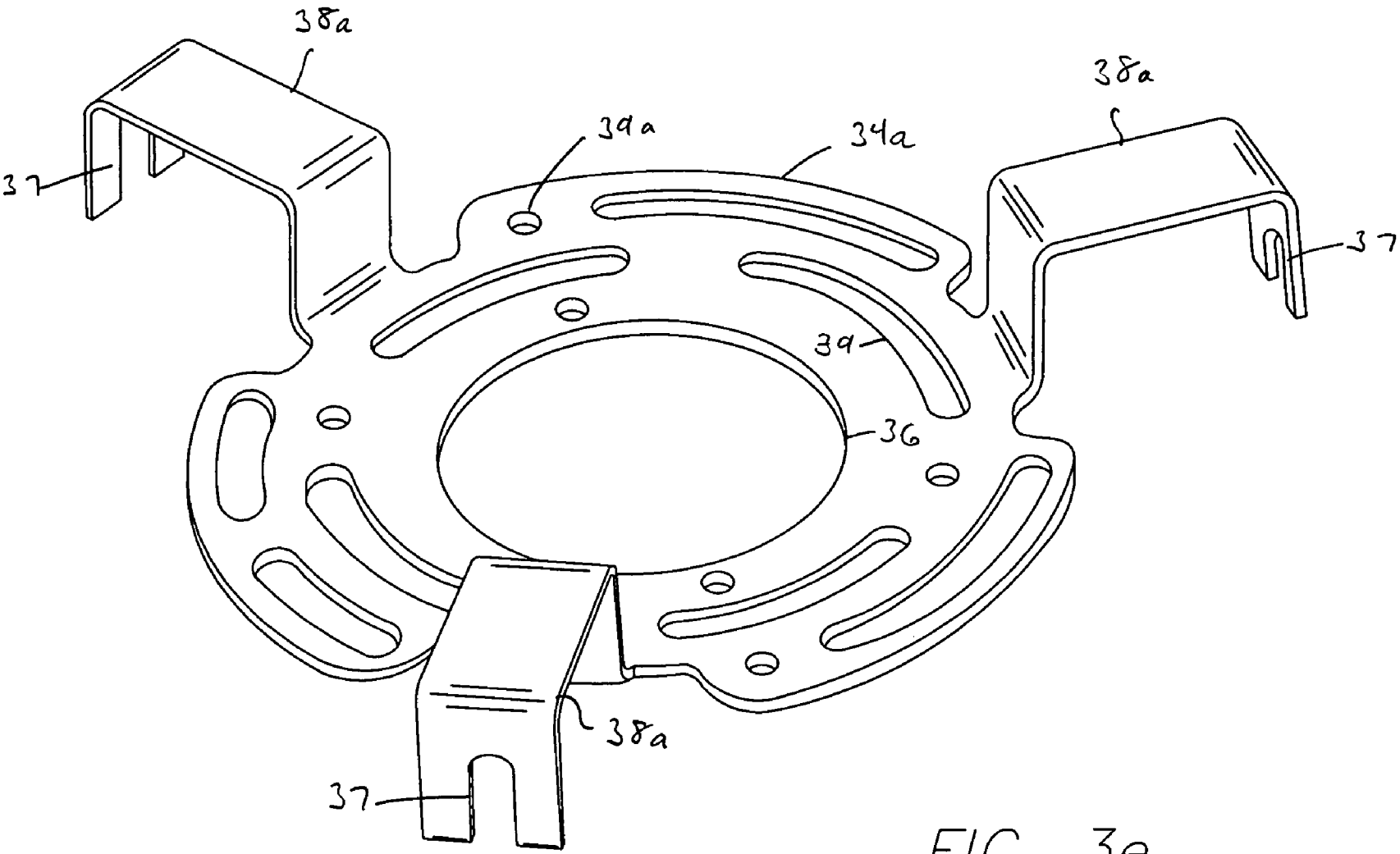
FIG. 3*e* is a bottom perspective view of another embodiment of the mounting bracket of the present invention having C-shaped prongs.
Figure 7A:
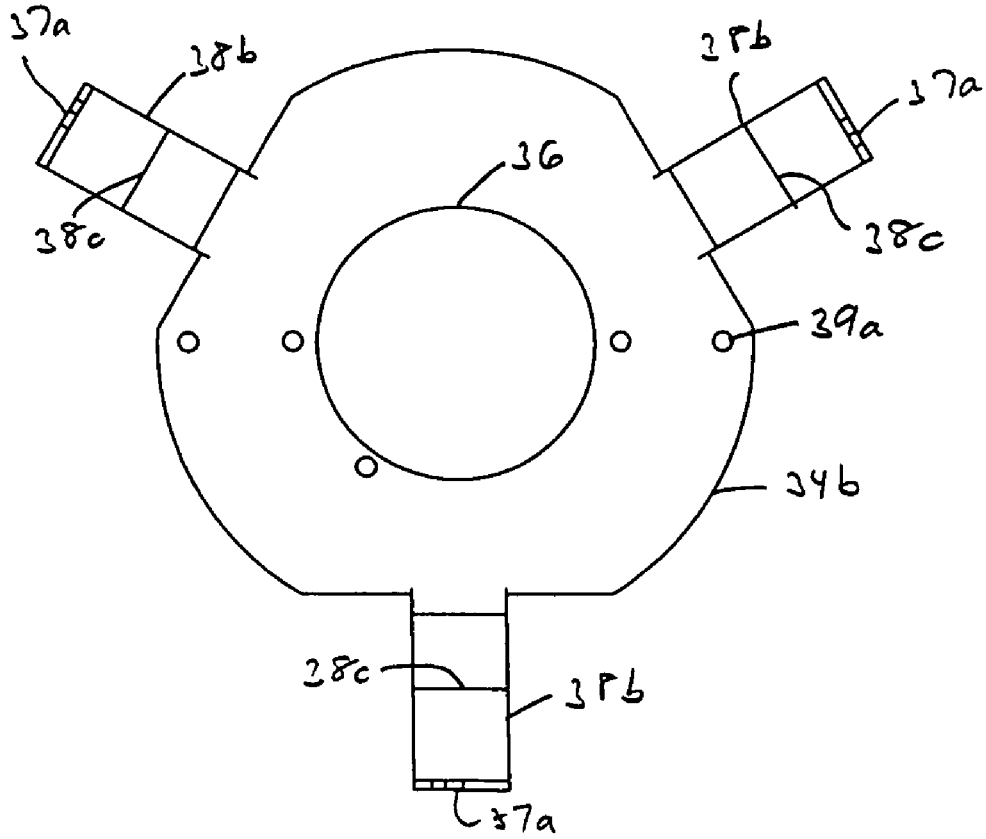
FIGS. 7*a* and 7*b* are bottom and sides views, respectively, of still another embodiment of the mounting bracket of the present invention having D-shaped prongs and a fastener locking mechanism.
Figure 7B:
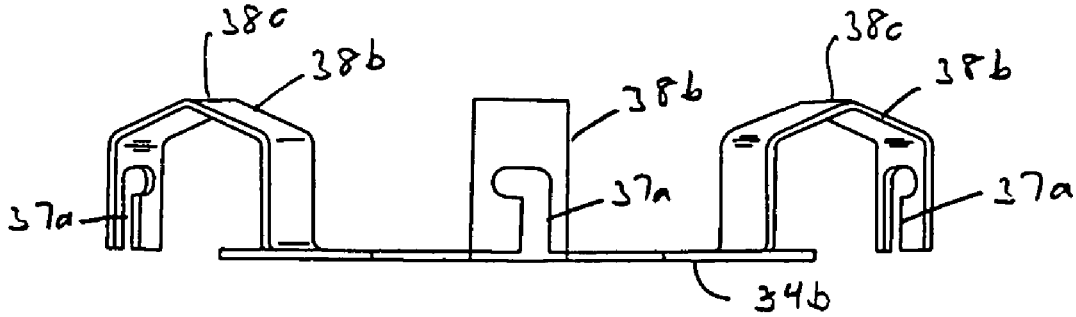

Another embodiment of the mounting bracket 30 is shown in FIG. 3*e* in which radially spaced prongs 38*a* extend from a lamp mounting portion (or plate) 34*a* are C-shaped. A further embodiment of the mounting bracket 30 is shown in FIGS. 7*a* and 7*b* in which prongs 38*b* extending from a substantially circular lamp mounting portion 34*b* are D-shaped and have P-shaped slots 37*a* each with a first vertical slot portion, similar to one of slots 37, and then a 90 degree angle to second horizontal slot portion. The first vertical slot portion is substantially parallel to the length of the can 18 between its open and closed ends, and the second horizontal slot portion is substantially parallel with the width of the can.

Figure 3F:
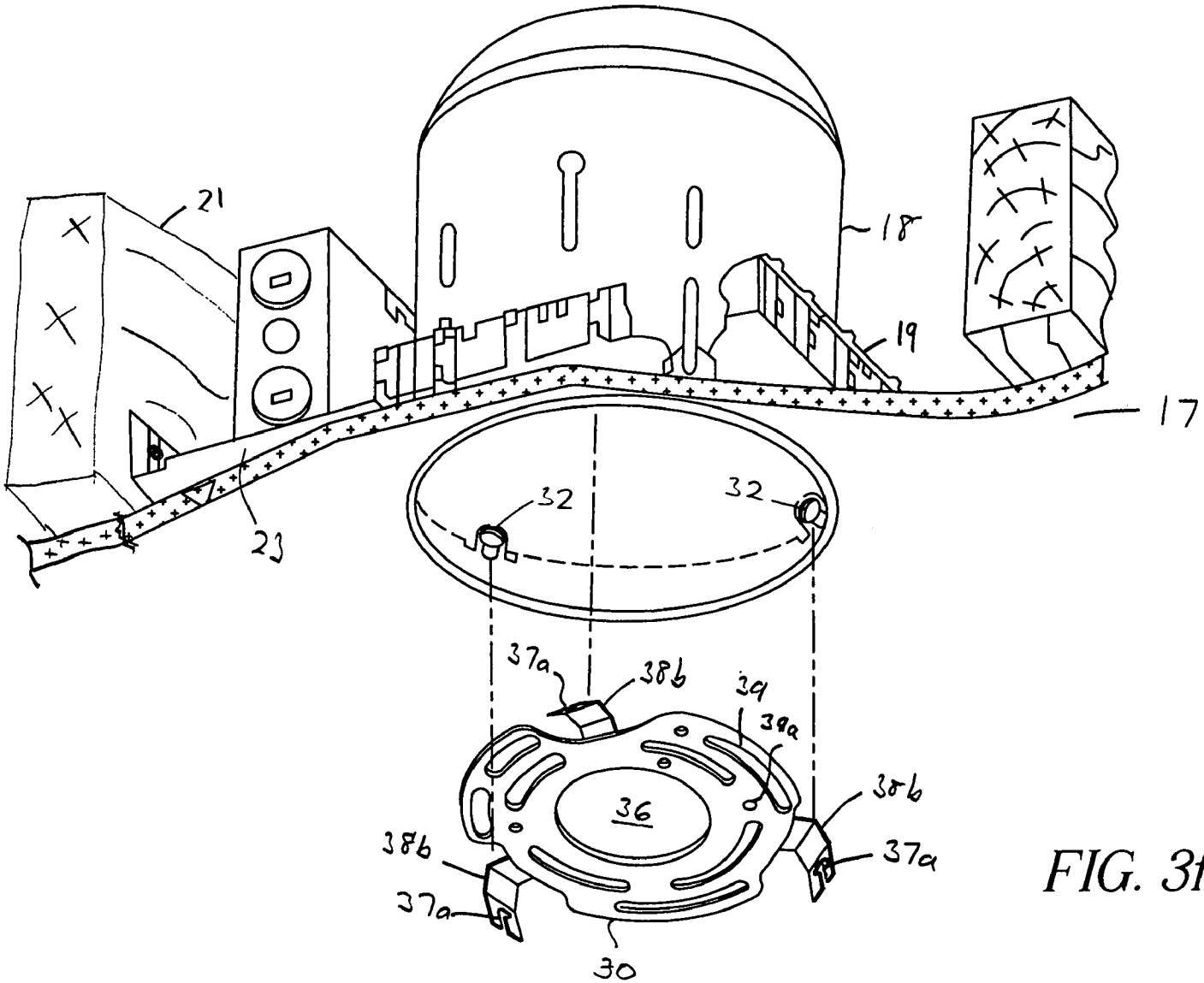
FIG. 3*f* is an exploded perspective view showing the mounting bracket of FIGS. 7*a-b* in recessed light can in which the mounting bracket is shown with arcuate slots along its lamp mounting portion.
Figure 3G:
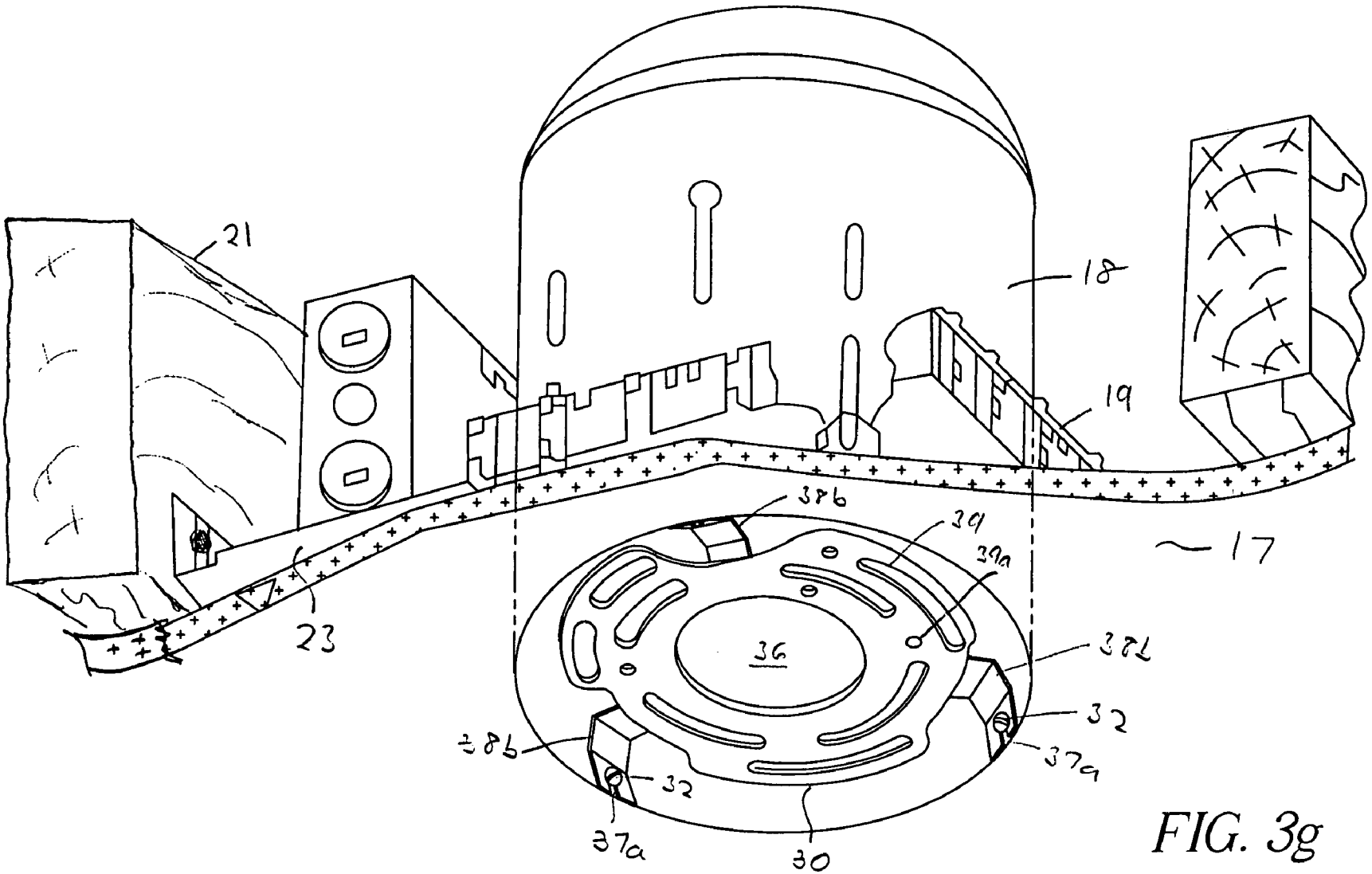
FIG. 3*g* is an view similar to FIG. 3*f* in which the mounting bracket of FIG. 3*f* is shown installed into a recessed light can.

The P-shaped slots 37*a* provide a fastener locking mechanism for the mounting bracket, in which once all fasteners 32 are received in the first vertical slot portions of slots 37*a* of prongs 38*b*, rotation of the mounting bracket locks the fasteners 32 into the horizontal slot portions of slots 37*a*. Locking provides additional support of mounting bracket 30 to the recessed housing 18. The D-shaped prongs 38*b* provides additional flexibility when locating the mounting bracket 30 in can 18 in which a person can easily bent the prongs either outward or inward, such as along bend 38*c*, to obtain a configuration facilitating location of the fasteners 32 into slots 37*a*. Alternatively, the D-shaped prongs 38*b* with slots 37 as in FIG. 3*e* rather than P-shaped slots 37*a*. The lamp mounting portion 34 or 34 and the prongs 38, 38*a*, or 38*b* are made of metal, such as steel, and the prongs are attached, such as by screws, or preferably welded to the lamp mounting portion. Alternatively, the lamp mounting portion and the prongs may be made from a single piece of material, in which the prongs are shaped to the desired shape. For purposes of illustration, slots 39 of mounting bracket 30 are not shown in FIGS. 7*a* and 7*b*, an example of such slots of the embodiment of FIGS. 7*a-b* are shown in FIGS. 3*f* and 3*g*. Also the location of slots 39 and holes 39*a* in the figures are exemplary, such slots 39 with or without holes 39*a* may be in other locations along bracket 30 depending on the mounting configurations of different non-recessed lamps so as to enable their attachment to the bracket. The mounting bracket 30 further includes a plurality of slots 39 and holes 39*a* for accommodating various mounting configurations of different non-recessed lamps. The mounting bracket 30 further includes a plurality of slots 39 and holes 39*a* for accommodating various mounting configurations of different non-recessed lamps. For example, screws 27 or 127 of FIGS. 2 and 6 may be attached to mounting bracket 30 via such slots 39 and/or holes 39*a* to attach canopy 26 or base 126. Although three prongs 38, 38*a*, or 38*b* are shown in the figures, more than three may be provided depending on the location of existing fasteners in can 18.

Figure 4:
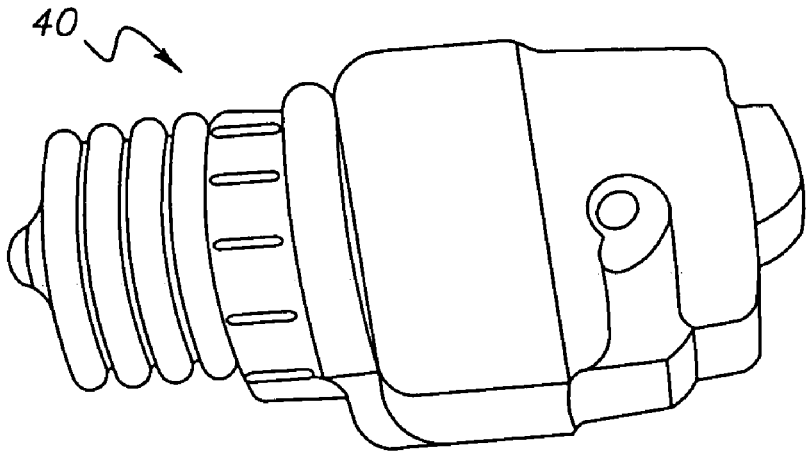
FIG. 4 is an image of the power adapter of FIG. 2.

A power adapter 40, shown in FIGS. 2 and 4, is configured to engage the light bulb receptacle 20 such as with mating screw threads. The light bulb receptacle 20 receives a standard incandescent light bulb. Alternatively, the light bulb receptacle 20 is configured to receive any type of bulb and the power adapter 40 is configured accordingly. The power adapter 40 is wired to individual wires of the power cord 28, which may include a live wire, a neutral wire, and a ground wire. The power adapter 40 thus places the power cord 28 in electrical communication with the light bulb receptacle 20, thereby providing power to the pendant lamp 12. The power adapter 40 is configured in a single piece. Alternatively, the power adapter 40 is provided in two pieces in which a first piece engages the light bulb receptacle 20 and a second piece is wired to the power cord 28. The first piece includes a power outlet on the exposed face and the second piece includes a power plug that mates with the outlet in the first piece.

The recessed light fixture 16 has been previously installed in the ceiling l7 and any face plates and light bulbs have been removed. The can 18 is affixed to a recessed light assembly which is mounted to the ceiling joists. (See FIGS. 3*f* and *g*.) The fasteners 32 hold the can 18 to the recessed light assembly. The light bulb receptacle 20 is in electrical communication with a junction box that is connected to a power source such as the AC power line in a house. When a non-recessed light is installed, a ring (or ring plate) 42 (FIG. 1*a*) can be used in case can 18 is too large to be covered by the canopy 26 of the non-recessed light, such that can 18 is not viewable. An example of a can 18 prior to and after attachment of a mounting bracket 30 is shown in FIGS. 3*f* and 3*g*, respectively, in which the ceiling 17 is shown in a broken view to show an example of a recessed light assembly 19 mounted to one of the ceiling joints 21 by a bracket 23 in ceiling 17. Fasteners 32, such as screws, mount the recessed can 18 to such recessed lamp assembly. The mounting bracket 30 of FIGS. 7*a*-7*b* with arcuate slots 39 of FIG. 3*e* is shown in FIGS. 3*f* and 3*g*, but the mounting bracket of FIGS. 3*a*, 3*b*, or 3*e* may similarly be attached to can 18.

Figure 5:
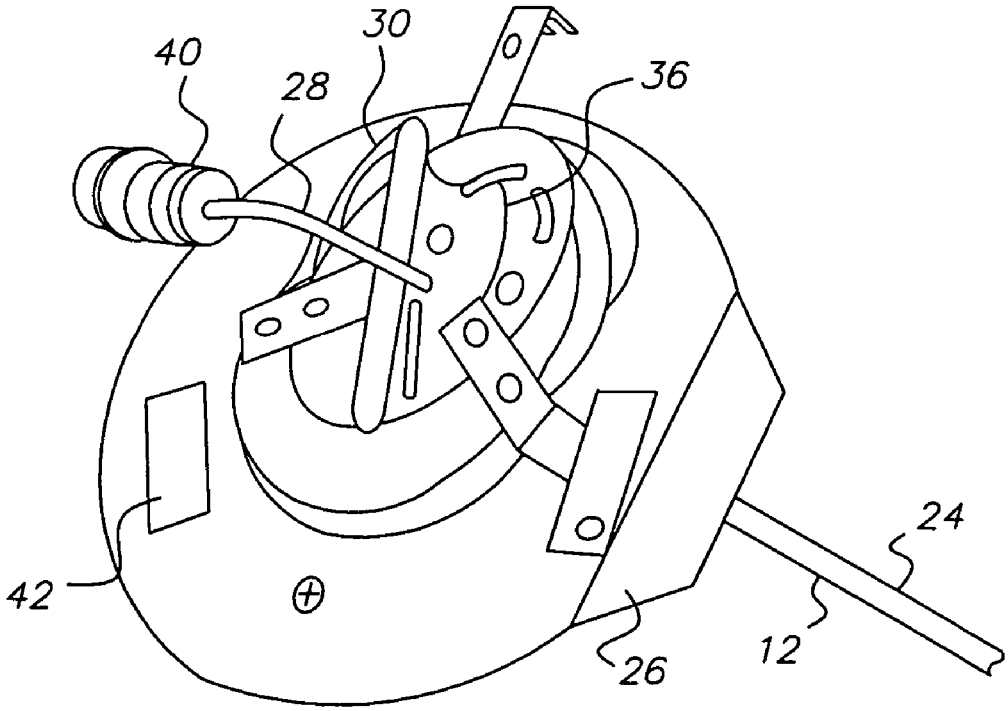
FIG. 5 is an image of the pendant lamp of FIG. 1 wired to the power adapter of FIG. 4.

In use, the pendant lamp 12 is retrofitted to the recessed light fixture 16 by passing the power cord 28 through the ring 42 (if included) and the bore 36 and then connected to the power adapter 40, as shown in FIG. 5. The pendant lamp 12 is fastened to the slots 39 similarly to the way the pendant lamp 12 would be mounted directly to the ceiling 17 in a non-retrofitting operation. The fasteners 32 are unscrewed only enough to provide a gap between the head of each fastener 32 and the inner surface of the can 18 for the prongs 38. The pendant lamp 12, the mounting bracket 30, and the power adapter 40 are lifted toward the can 18 and the installer reaches into the can 18 with the power adapter 40 to screw the same into the light bulb receptacle 20. The power cord 28 is long enough that the installer may reach into the can 18 and connect the power adapter 40 without the pendant lamp 12 or the mounting bracket 30 blocking the opening of the can 18. The pendant lamp 12 may need to be rotated to remove any twisting of the power cord 28 from installing the power adapter 40. The mounting bracket 30 is rotated so that the prongs 38 do not line up with the fasteners 32 and the mounting bracket 30 and pendant lamp 12 are lifted such that the mounting bracket 30 enters the can 18. The pendant lamp 12 and the mounting bracket 30 are then rotated until the prongs 38 are over the fasteners 32 and the pendant lamp 12 and the mounting bracket 30 are lowered such that prongs 38 (or 38*a*) via their slots 37 (or via slot 37*a* of prongs 38*b*) rest on the fasteners 32. (In the case of mounting bracket 30 having prongs 38*b*, once lowered the mounting bracket is rotated to lock the fasteners 32 to the prongs 38*b*.) The fasteners 32 are then tightened to secure the mounting bracket 30 in can 18. The pendant lamp 12 is now mounted securely to the ceiling 17 and connected to an appropriate power source both via the recessed light fixture 16. Although installation has been described for a pendant lamp, other non-recessed lamps may similarly be installed.

If during placement of mounting bracket 30 in can 18 prong slots 37 or 37*a* do not align properly with existing fasteners 38, or that no fasteners exist in the can 18, new holes should be drilled in the interior of the can 18 at radially location corresponding to prong slots 37 or 37*a* and then new fasteners may be provided in the holes drilled. Also, if the mounting bracket 30 has D-shaped prongs 38*b*, and such prongs extend to far or to short to reach fasteners 32, one or more of the prongs may be bent, such as with pliers, radially outward or inward to size the prongs to the interior surface of a recessed light can, such that prongs can be readily mounted to the existing or new fasteners of the recessed light can 18.

Figure 6:
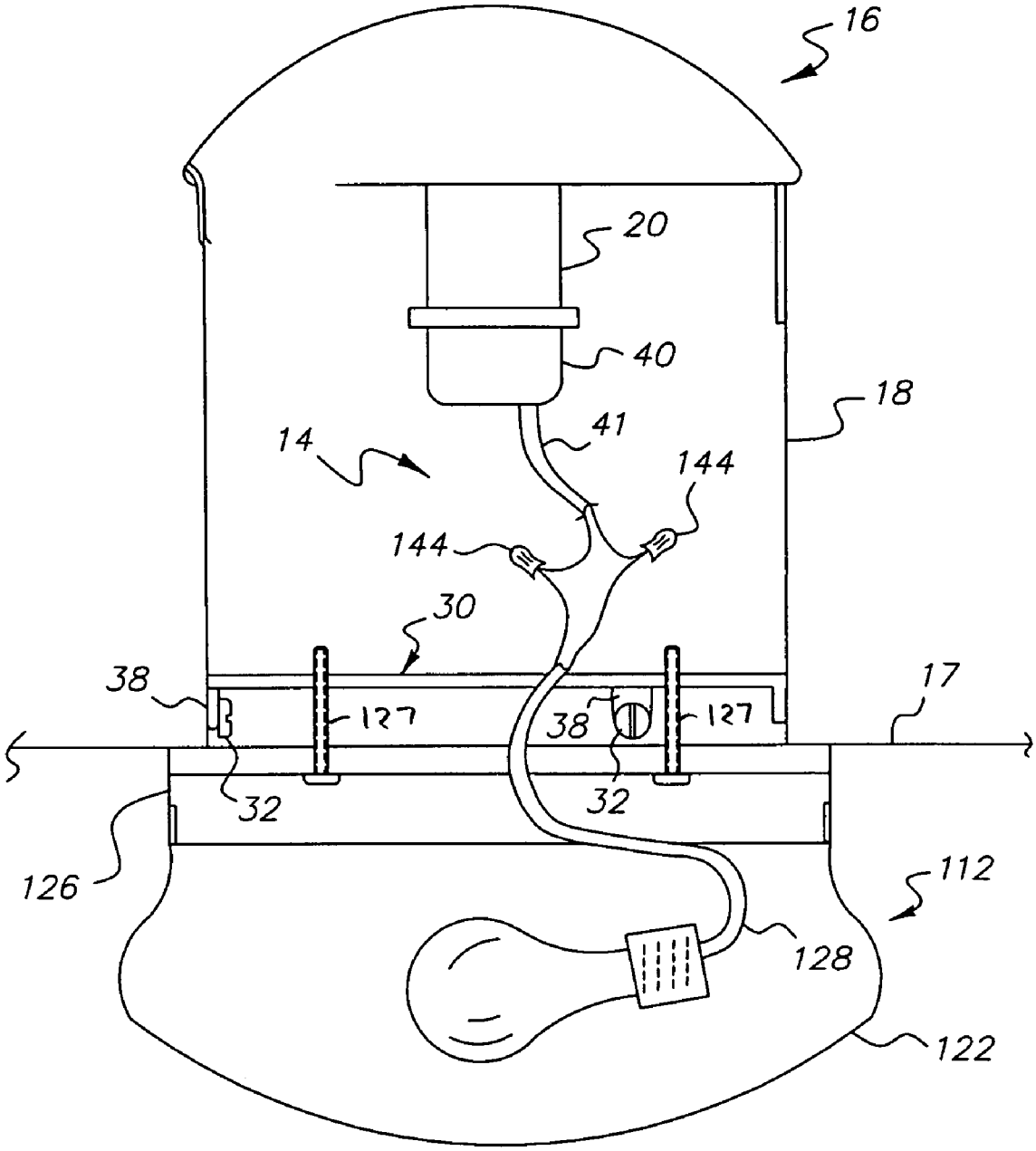
FIG. 6 is a cross-sectional view of a retrofitting light fixture according to a second embodiment.

In a second embodiment, shown in FIG. 6, a surface mount lamp 112 is mounted to the existing recessed light fixture 16 using the retrofitting components 14. The surface mount lamp 112 includes a cover 122, a lamp base 126, and a power cord 128. The lamp 112 may be configured to receive an incandescent, fluorescent, or other type of light bulb. The features of alternative surface mount lamps may vary from the one shown and additional features may be included. The lamp base 126 is fastened to the mounting bracket 30 similarly to the way it would be mounted directly to the ceiling 17 in a non-retrofitting operation. In the present embodiment, the power adapter 40 includes a lead wire 41. The power cord 128 is connected to the lead wire 41 by screw-on wire connectors 144 and the surface mount lamp 112 and retrofitting components 14 are assembled to the existing recessed light fixture 16 as described in the first embodiment with the pendant lamp 12. Alternatively, the power adapter 40 does not have a lead wire 41 and the power cord 128 is connected to the power adapter 40 as described in the first embodiment.

It should be noted that the power cord 28 in the first embodiment may be connected to the power adapter 40 through screw-on wire connectors 144 as described in the second embodiment. Preferably, screw-on wire connectors are used rather than a direct connection to the adapter 40 as shown in FIG. 2.

Figure 8:
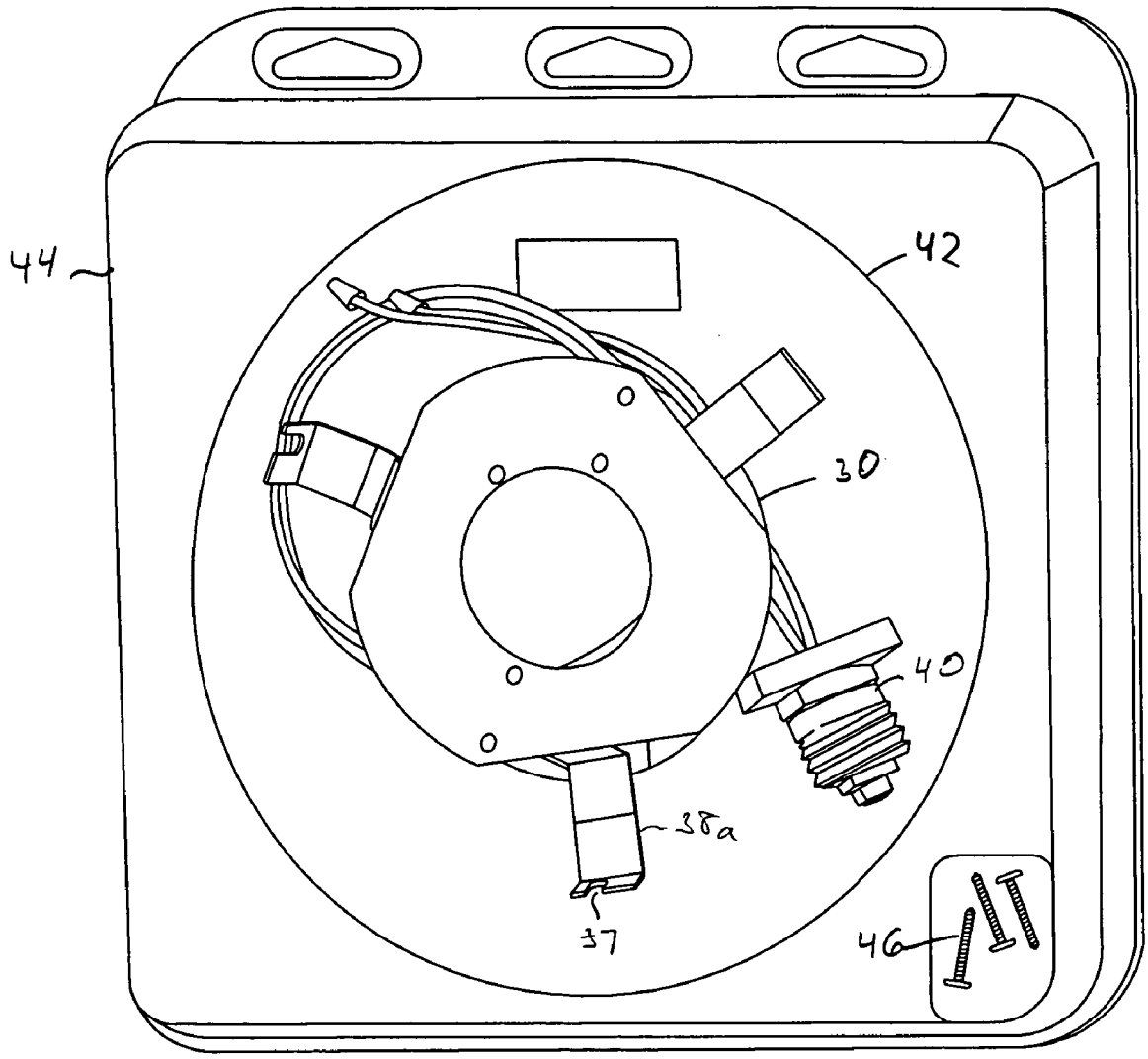
FIG. 8 is an example of a kit containing the components for retrofitting a recessed light fixture such that a non-recessed lamp may be installed.

Referring to FIG. 8 a conversion kit is shown having a plastic package 44, such as a clam-shell type, containing components for retrofitting a recessed light fixture such that a non-recessed lamp, such as a pendant lamp or surface mount lamp, may be installed. The components of the kit include: a mounting bracket 30; a ring 42; a power adapter 40 having wires extending there from; and screws 46. For purposes of illustration, mounting bracket 30 is shown with D-shaped prongs 28*b* and linear slots 37, and such kit may includes a mounting bracket 30 having one of the L-shaped, C-shaped or D-shaped prongs 28, 28*a*, 28*b*, respectively, described above, and one of linear slots 37 or P-shaped slots 37*a* in such prongs. In the preferred embodiment, the mounting bracket 30 in the kit has D-shaped prongs 28*b* and P-shaped slots 37*a* to provide both flexibility is mounting and fastener 32 locking, and the power adapter 40 is an integrated assembly having an end threaded to be received in a typical light bulb socket and wires 28 or 41 extending from such end to supply power to a non-recessed lamp from an existing light bulb socket. The screws 46 are provided, if needed, to add new fasteners when existing fasteners do not align with the prongs 38 or 38*a* or if no fasteners 32 exist in the can 18, as described earlier. Finishing ring 42 is included for application where the new non-recessed fixture's canopy is smaller in diameter than the existing can's opening in the ceiling.

Although a circular recessed light fixture is shown with a substantially circular mounting bracket, the recessed light fixture may be non-circular, such as a square or rectangular, and the mounting bracket is shaped accordingly such that prongs, such as four or more, can extend from the mounting bracket to fasteners, e.g., screws, along the interior of the recessed light housing.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. The apparatus for retrofitting a recessed light fixture for installing a non-recessed light fixture, said recessed light fixture having a recessed housing having an open end and a closed end in which said open end has an interior surface having a plurality of radially spaced fasteners, said apparatus comprising:

a mounting bracket having a plate with an outer edge and a plurality of prongs integral with said plate and extending radially outward from said outer edge of said plate, each of said prongs having an end with a slot into which one of said plurality of fasteners is received, in which said plate has at least one of a plurality of slots and openings for enabling attachment directly via said at least one of said slots and openings to a non-recessed light fixture when said mounting bracket in located in said open end of said recessed housing, wherein said recessed light fixture has a light bulb receptacle, and said apparatus further comprising a power adapter having an end locatable in the light bulb receptacle and electrical wires extending from said end capable of providing power to the non-recessed light fixture when attached to said mounting bracket located in said recessed housing, in which the wires extend through one of the openings in said plate.

2. The for retrofitting a recessed light fixture for installing a non-recessed light fixture, said recessed light fixture having a recessed housing having an open end and a closed end in which said open end has an interior surface having a plurality of radially spaced fasteners, said apparatus comprising:

a mounting bracket having a plate with an outer edge and a plurality of prongs integral with said plate and extending radially outward from said outer edge of said plate, each of said prongs having an end with a slot into which one of said plurality of fasteners is received, in which said plate has at least one of a plurality of slots and openings for enabling attachment directly via said at least one of said slots and openings to a non-recessed light fixture when said mounting bracket in located in said open end of said recessed housing, wherein said non-recessed light fixture is for supporting one of a pendant lamp or a non-recessed ceiling lamp.

3. The apparatus according to claim 2 wherein each of said prongs is C-shaped.

4. The apparatus according to claim 2 wherein each of said prongs is D-shaped.

5. The apparatus according to claim 4 wherein each of said prongs in bendable radially outward or inward to size the prongs to the interior surface of said recessed housing.

6. The apparatus according to claim 2 wherein said number of prongs is three.

7. The apparatus according to claim 2 wherein the slot of each of said prongs is linear in a direction parallel to the length of said housing between said closed and open ends.

8. The apparatus according to claim 2 wherein the slot of each of said prongs is P-shaped having a first slot portion, which is substantially parallel to the length of said housing between said closed and open ends when said mounting bracket in located in said open end of said housing, and a second slot portion extending from said first slot portion in which said second slot portion is substantially perpendicular to said first slot portion, wherein the slot of each of said prongs first receives one of the fasteners first along said first slot portion whereby rotation of the mounting bracket then locks the fasteners into the second slot portion.

9. The apparatus according to claim 2 wherein each of said prongs is L-shaped.

10. The apparatus according to claim 1 wherein said non-recessed light fixture is for supporting non-recessed ceiling lamp.

11. A light fixture comprising:

a mounting bracket that is fixable to an interior surface of a recessed light fixture;

a power adapter that mates with a light bulb receptacle, wherein the light bulb receptacle is affixed to the recessed light fixture; and a lamp that is in electrical communication with said power adapter and that is fixable to said mounting bracket wherein the interior surface of said recessed light fixture has a plurality of fasteners, and said mounting bracket has a generally disk shaped plate having an outer edge and a plurality of prongs internal with said plate and extending radially outward from said outer edge, each of said prongs having an end with a slot into which one of said plurality of fasteners is received to fix the mounting bracket to said interior surface, in which said plate has at least one of slots and openings to directly fix the lamp to said mounting bracket without an intermediate bracket.

12. The light fixture according to claim 11 wherein said lamp is one of a pendant and non-recessed ceiling lamp.

13. A method for retrofitting a non-recessed light fixture to an existing recessed light fixture, comprising the steps of:

a) affixing a mounting plate to said existing fixture, wherein said existing fixture is mounted to a support structure using a plurality of fasteners and said mounting plate is affixed to said existing fixture by the same plurality of fasteners;

b) wiring a lamp of said non-recessed light fixture to a power adapter that mates with a light bulb receptacle associated with said existing fixture;

c) mating the power adapter to the light bulb receptacle; and d) mounting said non-recessed fixture directly to said mounting plate.

14. The method according to claim 13 wherein said lamp is one of a pendant lamp and a non-recessed ceiling lamp.

15. A kit for converting a recessed light fixture for installation of a non-recessed light fixture comprising:

a mounting bracket which is fixable to an interior surface of a recessed light fixture for enabling installation of a non-recessed light fixture and has at least one slot or hole into which the non-recessed light fixture is directly fastenable;

a power adapter capable of mating with a light bulb receptacle of a recessed light fixture for enabling power to be received by the non-recessed light fixture; and a package containing at least said mounting bracket and said power adapter.

16. The kit according to claim 15 further comprising a ring sized to cover at least part of the recessed light fixture when a non-recessed light fixture is fastened to said mounting bracket.

17. An apparatus for retrofitting a recessed light fixture for installing a non-recessed light fixture comprising:

means fixable to an interior surface of a recessed light fixture in a ceiling having in said fixable means one or more holes and slots in which fasteners extend directly to said non-recessed fixture and suspend said non-recessed fixture below said ceiling for supporting a non-recessed light fixture extending from the ceiling; and means connectable to a light bulb receptacle of said recessed fixture and attachable to a light bulb receptacle of the non-recessed light fixture to provide power to the non-recessed light fixture.

18. The apparatus according to claim 1 wherein said non-recessed light fixture is for supporting a pendant lamp.

19. The apparatus according to claim 1 wherein at least one of said prongs in bendable radially outward or inward to size the prong to the interior surface of said recessed housing.

20. The apparatus according to claim 2 wherein said non-recessed light fixture has one of a canopy or base to provide support for said one of a pendant lamp or a non-recessed ceiling lamp, in which said one of said canopy or base is attachable directly to said mounting bracket when said mounting bracket is located inside said open end of said recessed housing.

21. The apparatus according to claim 20 wherein said one of a canopy or base is attachable to said mounting bracket by screws via said at least one of said slots and openings of said plate.

* * * * *